US005525070A

United States Patent [19]

Axelsson

[11] Patent Number: 5,525,070

[45] Date of Patent: Jun. 11, 1996

[54] POSITIVE LOCK INSULATED DISCONNECT

[75] Inventor: Lennart C. Axelsson, Tinley Park, Ill.

[73] Assignee: Panduit Corp., Tinley Park, Ill.

[21] Appl. No.: 227,949

[22] Filed: Apr. 15, 1994

[51] Int. Cl.[6] ..... H01R 11/22

[52] U.S. Cl. ..... 439/268; 439/849

[58] Field of Search ..... 439/832, 842, 439/846, 845, 848, 849, 850, 268, 266, 269, 270

[56] References Cited

U.S. PATENT DOCUMENTS

| | | | |
|---|---|---|---|
| 30,277 | 5/1980 | Simmons | 439/849 |
| Re. 30,277 | 5/1980 | Simmons | 434/849 |
| Re. 31,142 | 2/1983 | Simmons | 439/849 |
| 2,759,165 | 2/1952 | Batcheller | 439/849 |
| 3,076,171 | 4/1960 | Hopkins | 439/849 |
| 3,409,867 | 7/1966 | Lessner | 439/849 |
| 3,550,069 | 5/1968 | Teagno | 439/849 |
| 4,012,106 | 3/1977 | Filson | 439/850 |
| 4,220,388 | 9/1980 | Dechelette | 439/268 |
| 4,415,221 | 11/1983 | Inoue et al. | 439/849 |
| 4,423,921 | 1/1984 | Hall | 439/849 |
| 4,558,913 | 12/1985 | Goto et al. | 439/849 |
| 4,566,747 | 1/1986 | Peers | 439/849 |
| 4,632,483 | 12/1986 | Verin | 439/268 |
| 4,679,987 | 7/1987 | Jackson | 417/54 |
| 4,685,754 | 8/1987 | Coldren | 439/270 |
| 4,696,530 | 9/1987 | Vandame | 439/266 |
| 4,934,966 | 6/1990 | D'Urso | 439/849 |
| 4,973,271 | 11/1990 | Ishizuka et al. | 439/839 |
| 4,976,635 | 12/1990 | Gottardo et al. | 439/849 |

FOREIGN PATENT DOCUMENTS

| | | | |
|---|---|---|---|
| 3628783 | 10/1987 | Germany | 439/849 |

*Primary Examiner*—P. Austin Bradley
*Assistant Examiner*—Hien D. Vu
*Attorney, Agent, or Firm*—Mark D. Hilliard; Robert A. McCann

[57] ABSTRACT

An insulated electrical terminal for mating with a flat male tab having an insulated housing sleeve surrounding a metal terminal having a cantilevered locking tongue extending from a supported end of the terminal towards a tab receiving end, and including an upward curved section in the cantilevered tongue to increase the locking strength against pull-out. The electrical terminal further includes an angled forward release lever that cooperates with an angled cam surface formed within the insulated housing to depress the release lever so as to release the male tab from engagement with the cantilevered locking tongue.

26 Claims, 4 Drawing Sheets

POSITIVE LOCK INSULATED DISCONNECT

TECHNICAL FIELD

The present invention relates to an electrical terminal, and more particularly to an insulated electrical terminal for mating with a flat male tab.

BACKGROUND OF THE INVENTION

Electrical terminals having a receptacle end adapted to receive a plug terminal such as a flat male tab are well known in the art. Electrical terminals of this type, also known as disconnects, provide a reliable method for making quick and easy interconnections. Generally, these electrical terminals include a receptacle portion having an integral locking tongue for engaging the male tab, and a release member that allows for disconnection of the male tab from the locking tongue. These types of terminals also have a crimping section for terminating the end of a wire to the terminal. Furthermore, terminals of this type are often protected by an insulative housing.

While terminals of this type are well known in the art, there are still desirable features and advantages that have not previously been fulfilled. One important feature of disconnects of this type is that the male tab member, once engaged with the locking tongue, is prevented from inadvertent disconnection due to being pulled or shaken. This is of particular concern since many of the uses for electrical terminals of this type involve mechanical vibrations such as in automotive applications.

It is also an important feature for fully insulated electrical terminals that when disconnection of the male tab is desired, it can be readily accomplished. It is also desirable since these types of terminals and tabs are frequently disconnected and reconnected that it can be repeatedly performed without damaging or weakening the release member.

Summary of the Invention

It is therefore an object of the present invention to provide an improved electrical terminal.

It is further an object of the present invention to provide a female electrical terminal having an improved locking member.

It is another object of the present invention to provide an improved insulated electrical terminal.

It is still further an object of the present invention to provide an insulated electrical terminal having improved releasing means.

The foregoing objects are obtained by providing an insulated electrical terminal for mating with a male tab that generally includes a receptacle portion having a floor and a pair of opposed sidewalls having turned in extensions that terminate above the floor to form a tab receiving opening, an integral cantilevered tongue projecting from the floor of the receptacle portion and extending from a supported end towards the tab receiving opening, an upward curved section formed near the supported end of the cantilevered tongue, a locking projection on the cantilevered tongue that engages with the male tab, a release lever disposed upwardly from the cantilevered tongue for releasing the locking projection from an aperture of the male tab, wherein the release lever is disposed so as to be angled forwardly towards the tab receiving opening, and, an insulative housing sleeve for covering the terminal that includes an interior cam surface disposed at an angle equal to that in which the release lever is angled forward.

Other objects and advantages of the present invention will become apparent from the following detailed description.

Description of the Preferred Embodiment

Figure 2:
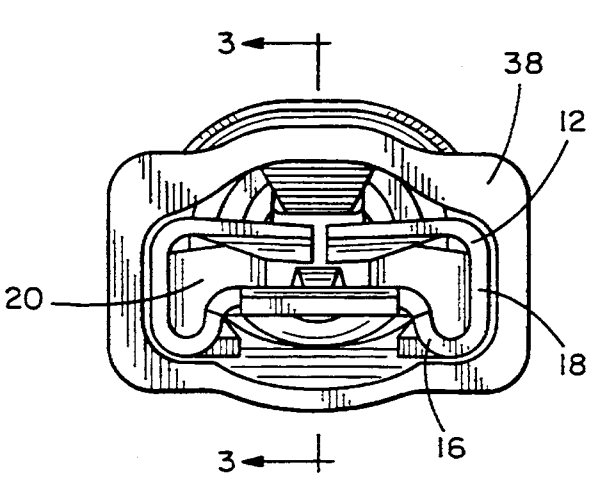
FIG. 2 is a front view of the insulated electrical terminal of FIG. 1.

The female insulated electrical terminal, or disconnect, of the present invention is designated generally by the reference numeral 10 in the accompanying drawings. The disconnect 10 includes an insulative housing 38 molded from plastic into a tubular housing sleeve for surrounding a metal electrical terminal part 12 which is formed from a plated or unplated brass strip by a stamping process and is adapted to terminate a wire 36 at one end, and to receive a male tab 44 at an opposite end.

Figure 1:
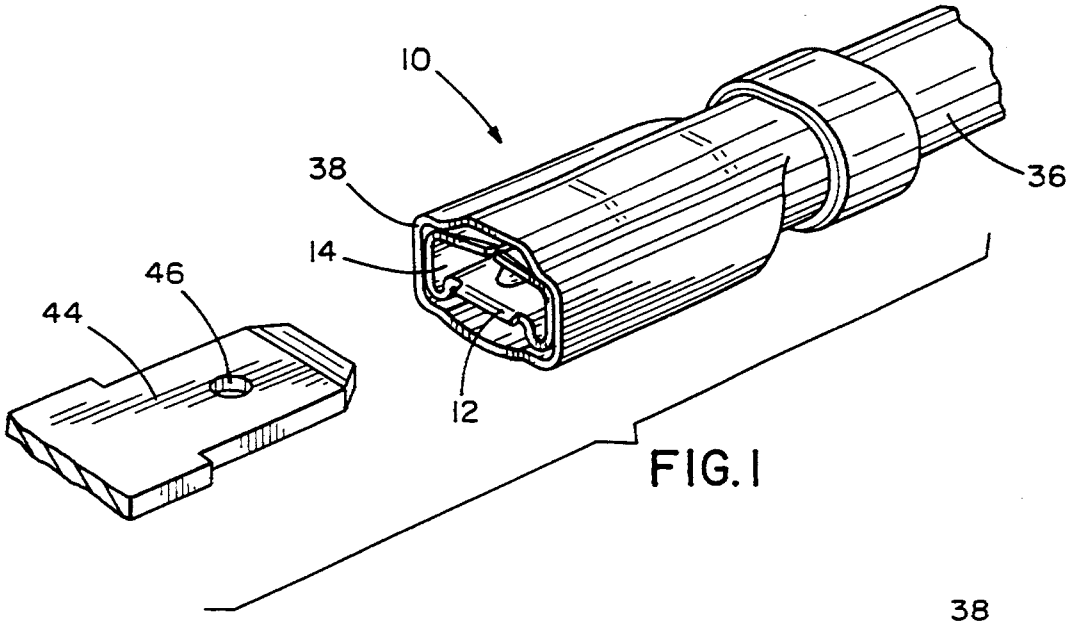
FIG. 1 is a perspective view of a male tab facing an insulated female electrical terminal embodying the concept of the present invention.
Figure 3:
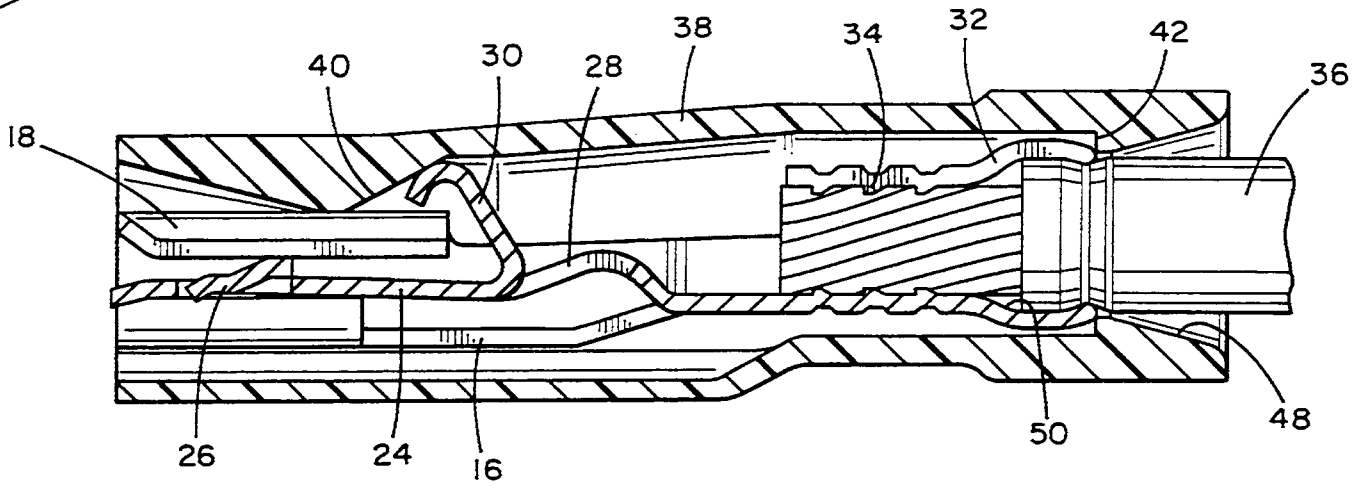
FIG. 3 is a cross-sectional side view of the insulated electrical terminal taken along lines 3–3 of FIG. 2.
Figure 4:
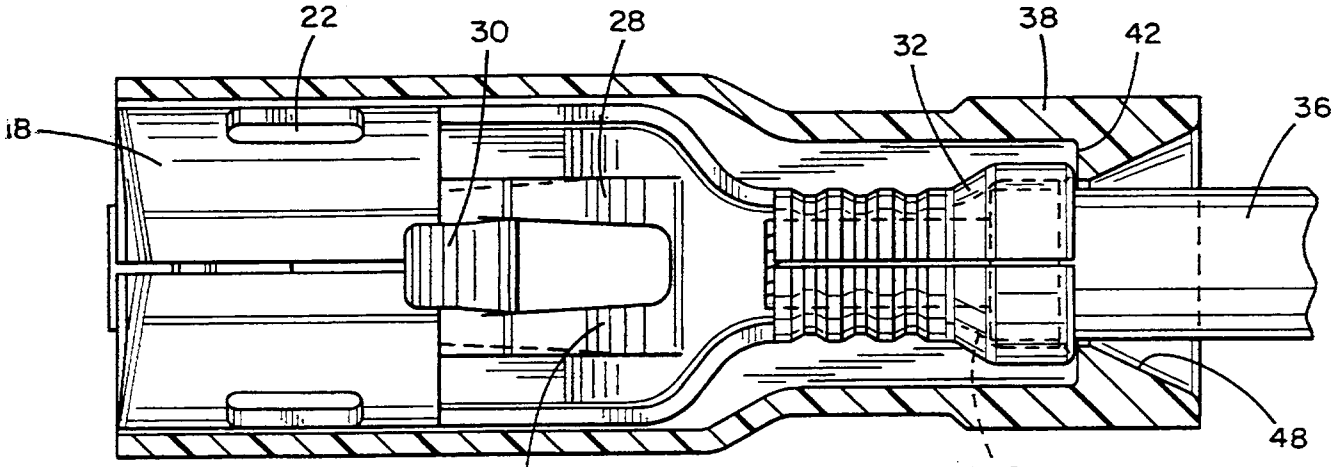
FIG. 4 is a top view of the insulated electrical terminal of FIG. 1 shown with the housing in cross-section.
Figure 5:
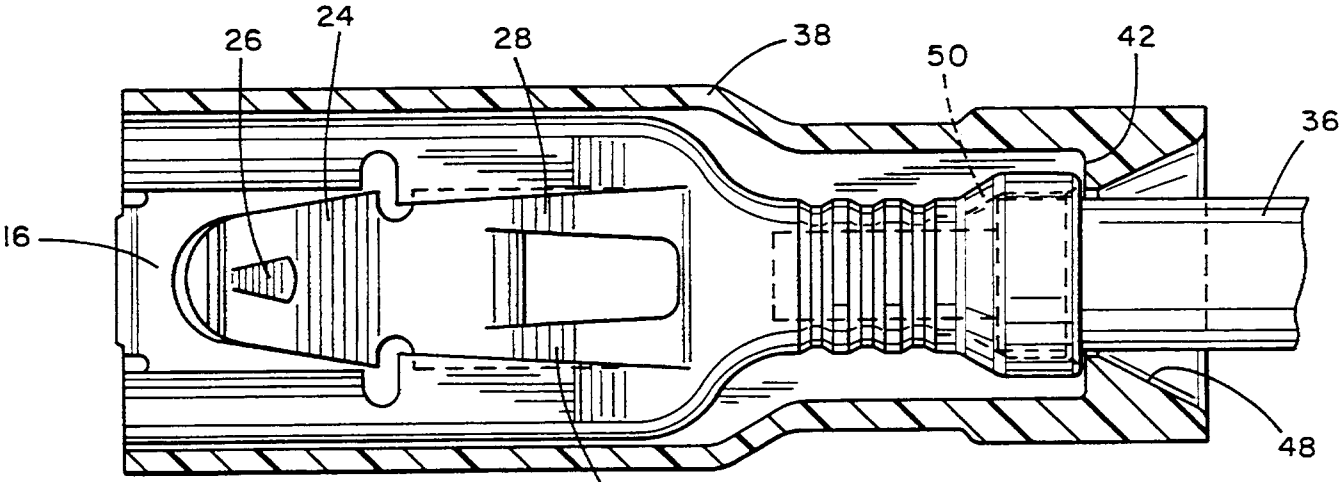
FIG. 5 is a bottom view of the insulated electrical terminal of FIG. 1 shown with the housing in cross-section.

As can be seen in FIGS. 1–3, terminal 12 includes a receptacle portion 14 formed with a floor 16 and integral sidewalls 18 inwardly bent over floor 16 so as to create a tab receiving opening 20 at the front of receptacle portion 14. As shown in FIG. 4, terminal 12 also includes a wire crimping portion at a rearward end that provides a wire crimp barrel 32 in which a wire 36 is crimped to the terminal 12. As can be seen in FIGS. 3 and 5, electrical terminal 12 is formed so as to include an integral cantilevered tongue 24 that is resiliently formed and projects from floor 16 at a point near wire crimping barrel 32, and extends from its supported end towards the tab receiving opening 20. Cantilevered tongue 24 includes a locking barb 26 projecting upwardly for engagement with a hole 46 in the male tab 44. There is further provided an integrally formed release lever 30 including a curved end facing the tab receiving opening 20 that is pushed downward to depress tongue 24 so as to release locking barb 26 from engagement with hole 46 in male tab 44. This depressing of release lever 30 allows for disconnection of male tab 44 from electrical terminal 12. Release lever 30 is formed by a portion cut from a rear end of cantilevered tongue 24 which is bent upwards. The remainder of the rear end of cantilevered tongue 24 is a pair of lateral edge portions remaining between the supported end and the release lever.

As can be seen in FIG. 3, an upwardly curved section 28 is formed at a rear end of cantilevered tongue 24 to help protect against inadvertent release of male tab 44 from electrical terminal 12 prior to release by depressing release lever 30. As best seen in FIGS. 3 and 4, upwardly curved section 28 is formed as a hump in the pair of lateral edge portions of tongue 24 remaining from where release lever 30 was upwardly formed. Upward curved section 28 is formed between the supported end of tongue 24 and the release lever 30. In the absence of upwardly curved section 28, as male tab 44 is pulled in an extracting direction out of receptacle portion 14, the cantilevered tongue 24 can flex downward slightly and inadvertent releasing of male tab 44 can occur. This is a result of the effective pivot location of the cantilevered tongue 24 being at the supported end where the cantilevered tongue 24 first projects from the rearward end of floor 16 of receptacle portion 14. By adding upward curved section 28, the effective pivot location is raised to a point on cantilevered tongue 24 on the tab receiving side of upwardly curved section 28. As a result, with upward curved section 28, when the engaged tab 44 is pulled in an extraction direction, the force on locking projection 26 does not depress cantilevered tongue 24 sufficiently to result in inadvertent releasing of male tab 44.

Figure 6:
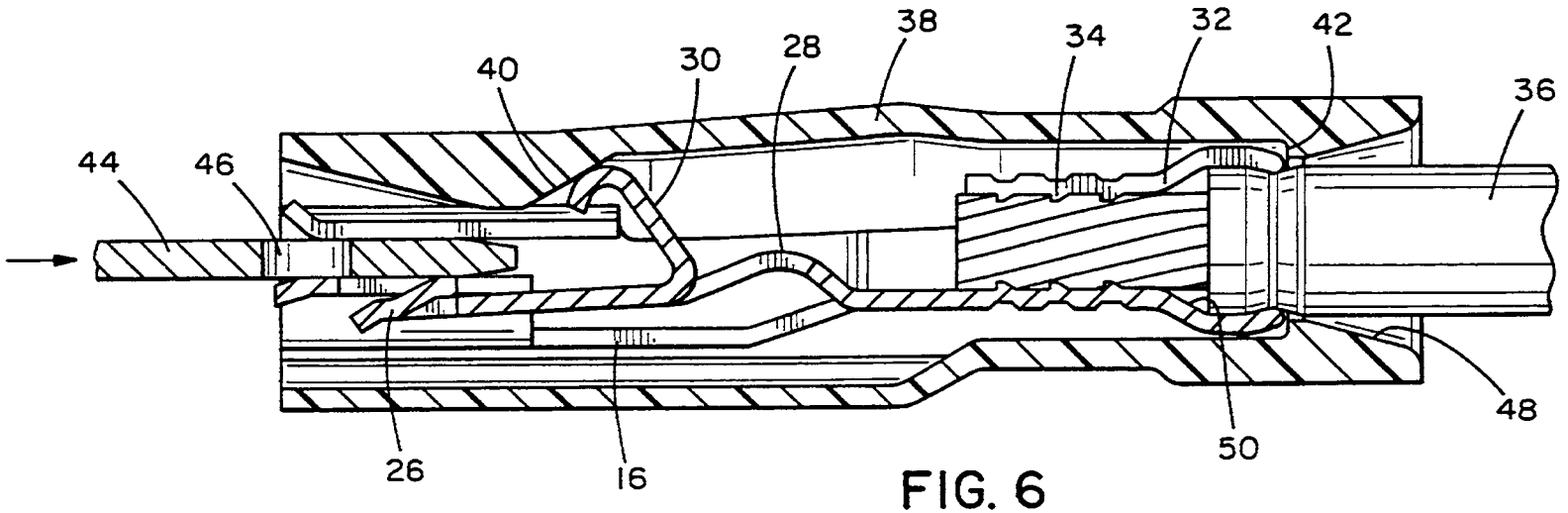
FIG. 6 is a cross-sectional side view of the insulated electrical terminal of FIG. 1 with a male tab being inserted.
Figure 7:
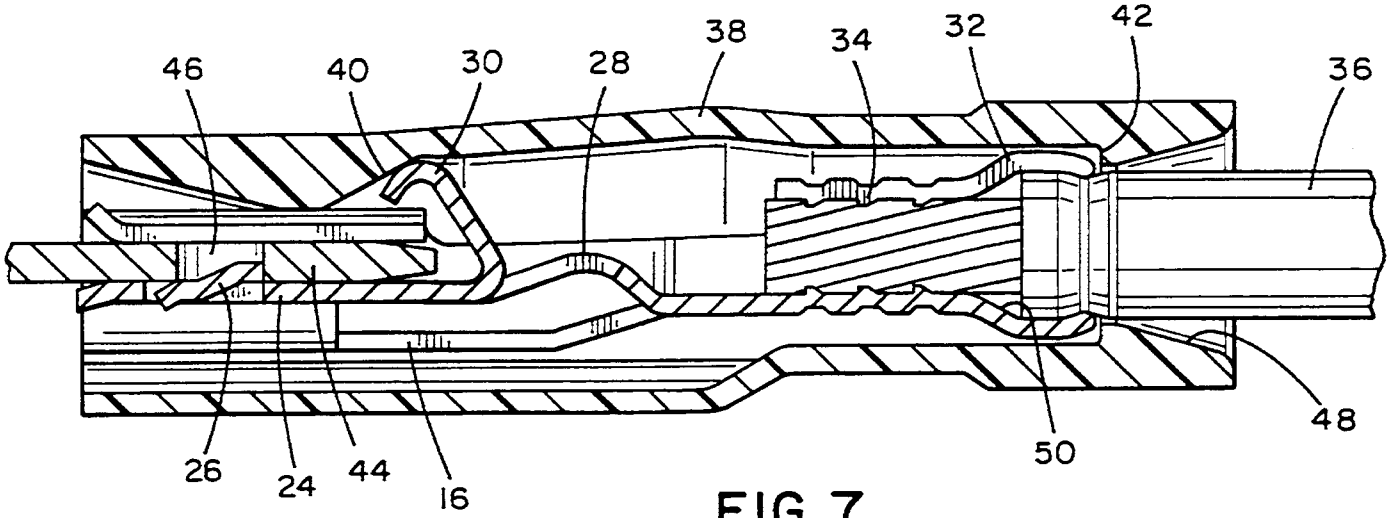
FIG. 7 is a cross-sectional side view of the insulated electrical terminal of FIG. 1 with the male tab lockingly engaged.
Figure 8:
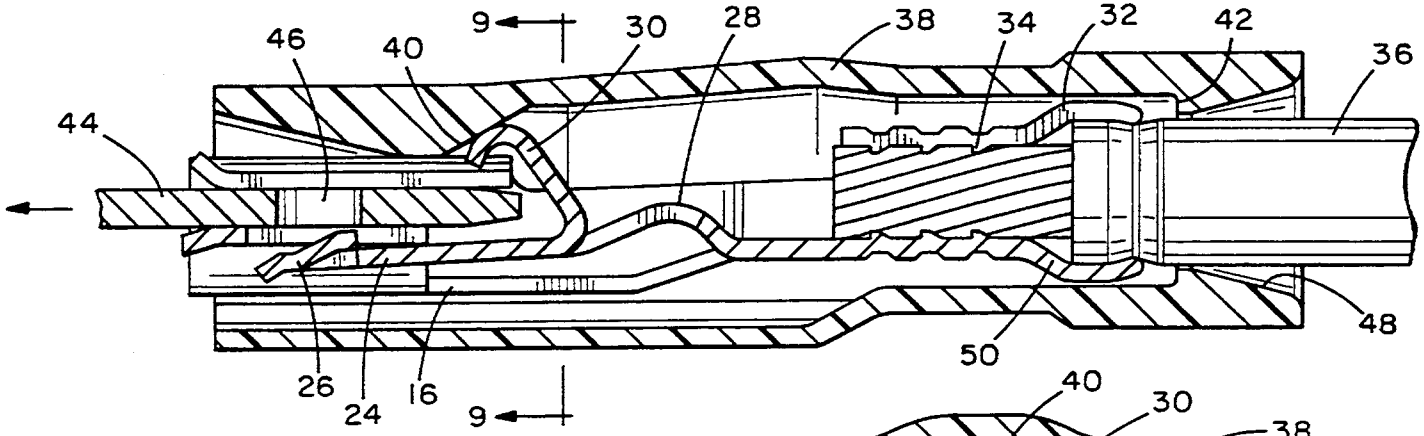
FIG. 8 is a cross-sectional side view of the insulated electrical terminal of FIG. 1 shown releasing the male tab.
Figure 9:
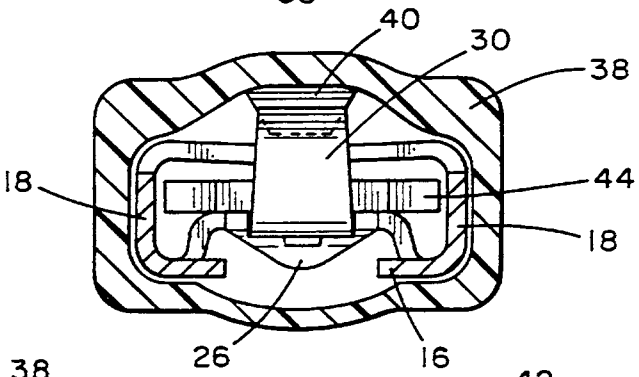
FIG. 9 is a view of the insulated electrical terminal along lines 9–9 of FIG. 8.
Figure 10:
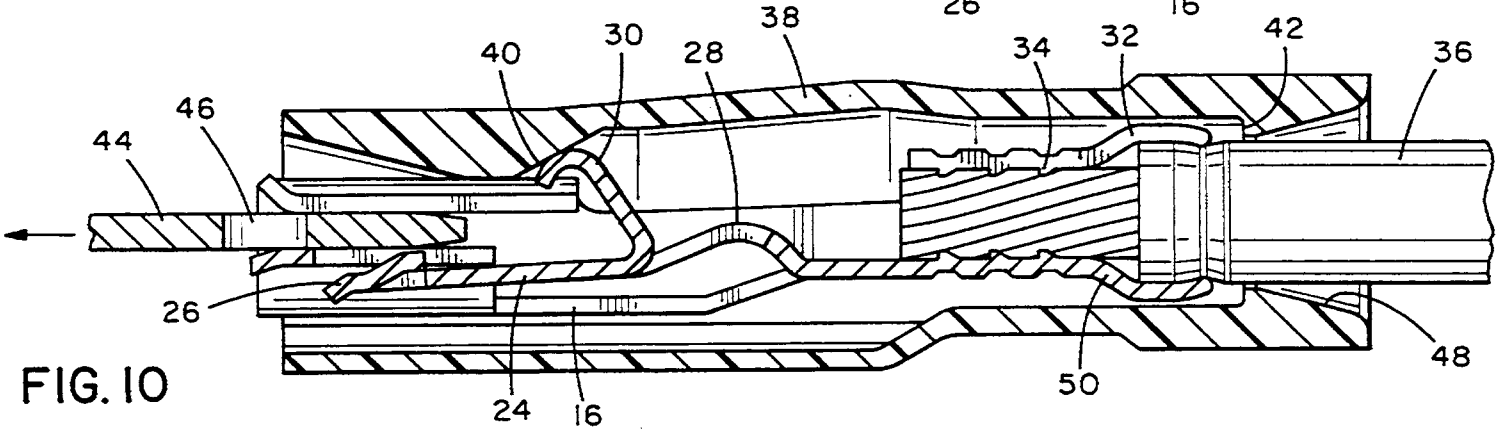
FIG. 10 is a cross-sectional side view of the insulated electrical terminal of FIG. 1 with the male tab being removed.

As shown in FIGS. 8 and 10, insulated housing 38 includes an angled cam surface 40 extending downward from an interior wall of housing 38. Electrical terminal 12 is inserted into housing 38 at a front end and pushed until the release lever 30 passes to the rearward side of cam surface 40. Housing stops 42 are formed in the interior at the rear end of the housing 38 which prevent the terminal from passing through housing 38. Release lever 30 has an interference fit with the housing 38 and cam surface 40 that helps seat terminal 12 within housing 38. The movement of terminal 12 is limited within housing 38 by stops 42 formed at the rear end of housing 38. Movement in the forward direction is also limited by the engagement of cam surface 40 with the release lever 30. As can be seen in FIGS. 6 and 7, the rear end of housing 38 includes a funnel entry ramp 48 for easing insertion of the wire 36 to be crimped to terminal 12. Crimp barrel 32 is also provided with a funnel entry portion 50 that serves to ease insertion of wire 36 and to allow for strain relief crimping by having both an insulated portion and an uninsulated portion of wire 36 be crimped. Once the electrical terminal 12 has been positioned within insulated housing 38, the wire 36 is inserted into the crimp portion and crimped to the insulated disconnect 10.

As can be seen in FIG. 1, male tab 44 includes a hole 46 and is inserted into the tab receiving channel of the electrical terminal 12. The ends of floor 16 and turned in sidewalls 18 are flared outwardly to ease insertion of male tab 44. As shown in FIG. 6, during the initial insertion of tab 44 the cantilevered tongue 24 is flexed downward by the pressure on locking projection 26 until the hole 46 in male tab 44 engages locking projection 26. Male tab 44 is lockingly secured to the electrical terminal 12 until released by depressing release lever 30 which moves the cantilevered tongue downwardly to release locking projection 26 from hole 46.

As best seen in FIGS. 8 and 10, when it is desired to release the tab from the insulated disconnect in the locked position as shown in FIG. 7, insulating housing 38 can be pulled rearwardly with respect to electrical terminal 12 which causes cam surface 40 to engage and cooperate with the top curved section of release lever 30 to press down on cantilever tongue 24 and thereby release locking projection 26 from hole 46 so that tab 44 can be removed. The cam surface 40 is formed to be at an angle of approximately 30 degrees from the housing sleeve and to be approximately equal to the angle with which release lever 30 is angled forward from the vertical. Therefore, the forces exerted on the release lever 30 by cam surface 40 are advantageously aligned with the release lever 30. This angling forward of release lever 30 and the cooperation with similarly angled cam surface 40 helps strengthen release lever 30 against over-insertion of male tab 18, and against the effects of repeated disconnection and reconnection.

As can be seen in FIGS. 6 and 7, the rear end of housing 38 includes a funnel entry ramp 48 for easing insertion of the wire 36 to be crimped to terminal 12. Crimp barrel 32 is also provided with a funnel entry portion 50 that serves to ease insertion of wire 36 and to allow for strain relief crimping by having both an insulated portion and an uninsulated portion of wire 36 be crimped.

It is to be noted that the embodiment herein described includes a crimp barrel end having ribbed rings 34 that are crimped around a wire 36 that is terminated to the terminal 12. Other crimping means could be used, including cut serrations formed in the crimp barrel. It is also to be noted that the curl slots 22 formed at the corners of the turned in sidewalls 18 of electrical terminal 12 are optional but can be of assistance in the forming of the metal terminal 12.

While the particular embodiments of the present invention have been shown and described, it will be obvious to those skilled in this art that changes and modifications may be made without departing from the invention in its broader aspects. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical terminal for mating with a male tab comprising:

a receptacle portion having a floor and a pair of opposed sidewalls having turned in extensions that terminate above the floor to form a tab receiving opening;

an entire integral cantilevered tongue projecting upwardly from the floor and extending from the floor at a supported end of the cantilevered tongue towards the tab receiving opening;

an upward curved section formed near the supported end of the cantilevered tongue; and locking means disposed on the cantilevered tongue for engaging with the male tab.

2. An electrical terminal according to claim 1, wherein the locking means comprises a raised portion of the cantilevered tongue forming a locking projection that engages with an aperture of the male tab.

3. An electrical terminal according to claim 2, further including a release lever projecting upwardly from the cantilevered tongue.

4. An electrical terminal according to claim 3, wherein the release lever is forwardly angled towards the tab receiving opening.

5. An electrical terminal according to claim 4, wherein the upward curved section is formed as a hump in a pair of lateral edge portions of the tongue disposed between the supported end and the release lever.

6. An electrical terminal according to claim 5, further including an insulative housing covering the terminal.

7. An electrical terminal according to claim 6, wherein the insulative housing is formed as a tubular sleeve.

8. An electrical terminal according to claim 7, wherein the housing sleeve includes a cam surface formed on an interior wall of the housing sleeve that cooperates with the release lever to allow for release of the male tab.

9. An electrical terminal according to claim 8, wherein the cam surface is formed at an angle with respect to the housing sleeve equal to that in which the release lever is angled forward.

10. An insulated electrical terminal according to claim 9, wherein the release lever is angled forward approximately 30 degrees.

11. An electrical terminal according to claim 10, further including a wire crimping portion adjacent the receptacle portion that includes a wire crimping barrel.

12. An insulated electrical terminal for mating with a male tab comprising:

a receptacle portion having a floor and a pair of opposed sidewalls having turned in extensions that terminate above the floor to form a tab receiving opening;

a resilient tongue integrally formed and projecting upwardly from the floor including an upwardly formed hump;

locking means disposed on the tongue for engaging with the male tab;

a release lever projecting upwardly from the tongue and disposed so as to be angled forwardly from a vertical direction with respect to the floor towards the tab receiving opening; and an insulative housing sleeve including an interior cam surface that cooperates with the release lever to allow for release of the male tab.

13. An electrical terminal according to claim 12, wherein the cam surface is formed at an angle with respect to the housing sleeve equal to that in which the release lever is angled forward.

14. An insulated electrical terminal according to claim 13, wherein the release lever is angled forward approximately 30 degrees.

15. An insulated electrical terminal according to claim 14, wherein the resilient tongue comprises a cantilevered tongue projecting from the floor and extending from the floor at a supported end of the cantilevered tongue towards the tab receiving opening.

16. An insulated electrical terminal according to claim 15, wherein the upwardly curved hump formed on the cantilevered tongue is formed near the supported end.

17. An electrical terminal according to claim 16, wherein the upward curved hump is formed as an upwardly curved section in a pair of lateral edge portions of the tongue between the supported end and the release lever.

18. An insulated electrical terminal according to claim 17, further including a wire crimping portion adjacent the receptacle portion that includes a wire crimping barrel.

19. An insulated electrical terminal for mating with a male tab comprising:

a receptacle portion having a floor and a pair of opposed sidewalls having turned in extensions that terminate above the floor to form a tab receiving opening;

a resilient tongue integrally formed and projecting upwardly from the floor;

locking means disposed on the tongue for engaging with the male tab;

a release lever projecting upwardly from the tongue and disposed so as to be angled forwardly from a vertical direction with respect to the tongue towards the tab receiving opening; and an insulative housing sleeve including an interior cam surface that cooperates with the release lever to allow for release of the male tab.

20. An insulated electrical terminal according to claim 19, wherein the cam surface is formed at an angle with respect to the housing sleeve equal to that in which the release lever is angled forward.

21. An insulated electrical terminal according to claim 20, wherein the release lever is angled forward approximately 30 degrees.

22. An insulated electrical terminal according to claim 19, wherein the resilient tongue is formed as a cantilevered tongue projecting from the floor and extending from the floor at a supported end of the cantilevered tongue towards the tab receiving opening.

23. An insulated electrical terminal according to claim 22, wherein the cantilevered tongue includes an upwardly curved hump.

24. An insulated electrical terminal according to claim 23, wherein the upwardly curved hump formed on the cantilevered tongue is formed near the supported end.

25. An insulated electrical terminal according to claim 24, wherein the upward curved hump is formed as an upwardly tongue between the supported end and the release lever.

26. An insulated electrical terminal according to claim 25, further including a wire crimping portion adjacent the receptacle portion that includes a wire crimping barrel.

* * * * *